United States Patent [19]

Miller et al.

[11] Patent Number: 4,934,528

[45] Date of Patent: Jun. 19, 1990

[54] MIRROR POUCH

[75] Inventors: Joseph T. Miller, St. Louis County; Edward F. Brown, St. Francois County, both of Mo.

[73] Assignee: MOCAP, St. Louis, Mo.

[21] Appl. No.: 375,341

[22] Filed: Jul. 3, 1989

Related U.S. Application Data

[63] Continuation-in-part of Ser. No. 307,920, Feb. 9, 1989, Pat. No. 4,907,694.

[51] Int. Cl.[5] ..... A45C 11/32; A45D 42/04

[52] U.S. Cl. ..... 206/235; 206/37.1

[58] Field of Search ..... 206/37.1, 38.1, 38, 206/37, 581, 235; 132/316, 333

[56] References Cited

U.S. PATENT DOCUMENTS

| | | | |
|---|---|---|---|
| 1,532,030 | 3/1925 | Bonime | 132/316 |
| 2,111,079 | 3/1938 | Spear et al. | 206/38 R |
| 2,125,354 | 8/1938 | Meier | 206/38.1 |
| 3,353,579 | 11/1967 | Bechter et al. | 206/37.1 |
| 4,161,201 | 7/1979 | Carp | 190/110 |

FOREIGN PATENT DOCUMENTS

| | | | |
|---|---|---|---|
| 819964 | 7/1949 | Fed. Rep. of Germany | 206/37.1 |
| 3727120 | 8/1987 | Fed. Rep. of Germany | 206/38.1 |

*Primary Examiner*—Paul T. Sewell
*Assistant Examiner*—Jacob K. Ackun, Jr.
*Attorney, Agent, or Firm*—Paul M. Denk

[57] ABSTRACT

A mirror pouch for use with a key ring or the like is disclosed as including a one-piece flat receptacle that is formed from flexible and resilient material and is so shaped that the receptacle may be temporarily deformed by a squeezing force applied thereto so as to open a mirror opening in the receptacle for entry and/or removal of an associated flat mirror. The mirror opening is also provided with a fastener to releasably fasten the sidewalls of the receptacle until it is desired to insert or remove the mirror, at which point the receptacle is temporarily deformed in the manner described above.

7 Claims, 1 Drawing Sheet

MIRROR POUCH

CROSS REFERENCE TO RELATED APPLICATIONS

This is a continuation-in-part of patent application Ser. No. 07/307,920 filed Feb. 9, 1989 entitled "COIN POUCH", now U.S. Pat. No. 4,907,694, and is a related application to Ser. No. 07/375,342 filed on an even date herewith and entitled "FINGERNAIL CLIPPER POUCH".

BACKGROUND OF THE INVENTION

The present invention relates to a mirror pouch for use with a key ring or the like, and more particularly to a conveniently accessible and protective mirror pouch containing a mirror within a mirror compartment, the pouch capable of being temporarily deformed and resiliently opened to dispose a mirror opening for inserting and/or removing a mirror from the pouch, with the mirror pouch also being pivotally and foldably connected to the key ring, to facilitate convenient carrying or storage of the mirror pouch and associated key ring.

The flexible and mobile society of the late 20th century has created the need for many products that are adapted to meet the needs of a consumer oriented society that demands convenience. Extended times for recreation, particularly associated with the use of the automobile, has provided new and increasing opportunities for products that can be readily and conveniently used in a wide variety of times and circumstances.

One such product for this purpose is the "COIN POUCH", disclosed in my aforementioned prior parent patent application, in which a coin purse and associated key ring are well suited for this purpose. The coin pouch is inherently resilient, but is constructed such that compression of the coin pouch will temporarily deform same in order to readily expose an opening for immediate insertion and/or removal of coins therefrom, and upon release, resiliently closes the pouch into its normal condition, enabling a hook and pile type of releasable fastening means to secure the pouch and any coins contained therein. The coin pouch and associated key ring are also pivotally and foldably connected to one another to facilitate a generally overlapped relationship for convenient carrying or storage thereof.

Attention is also directed to my aforementioned copending patent application filed on the same date herewith and entitled "FINGERNAIL CLIPPER POUCH"which discloses another flexible pouch/key ring product which is generally similar, but for an entirely different product and purpose.

The present invention relates particularly to a mirror pouch and associated key ring providing in convenient access and availability of a mirror contained within the mirror pouch, while also enabling the mirror pouch key ring to be foldably and conveniently carried or stored, as may be desired.

SUMMARY OF THE INVENTION

Among the several objects and advantages of the present invention include:

The provision of a mirror pouch for use with a key ring which provides convenient access and availability for the use of a mirror wherever an associated key ring containing car and home keys may be located;

The provision of the aforementioned mirror pouch and associated key ring in which the mirror is safely and protectively carried within an enclosed receptacle what is fabricated from a material which absorbs external forces;

The provision of the aforementioned mirror pouch and associated key ring which provides convenient opening by one-handed manipulation thereof;

The provision of the aforementioned mirror pouch and associated key ring wherein the mirror pouch is made from a resilient and flexible material which may be temporarily deformed by force applied thereto in order to expose an opening for the entry and/or removal of the mirror from the mirror pouch;

The provision of the aforementioned mirror pouch and associated key ring wherein the mirror pouch and key ring are pivotally and foldably connected to one another so as to be positioned in general overlapping relationship for convenient carrying or storage thereof;

The provision of the aforementioned mirror pouch and associated key ring which incorporates releasable fastening means for releasably securing the mirror pouch in a closed position, but readily facilitating opening thereof; and The provision of the aforementioned mirror pouch and associated key ring which is compactly and efficiently designed and constructed, does not create substantial bulk when stored in a user's pocket or in a user's purse; and is otherwise adapted for the purposes intended.

Furthermore, this invention is a convenient item for use by the female to furnish instant assurance of the proper application of cosmetics and hair arrangment.

Briefly stated, the present invention relates to a mirror pouch for use with a key ring or the like wherein the mirror pouch comprises an integral one-piece receptacle constructed of a resilient and flexible material. The receptacle defines a flat mirror compartment and includes a pair of generally flat sidewalls integrally connected to one another at least around a substantial portion of the perimeter thereof and also being separated from one another along a predetermined area thereof which is sufficient to define an opening for entry and removal of the flat mirror within the receptacle. The receptacle is temporarily deformable by force applied around the integrally connected periphery thereof to separate the sidewalls from one another so as to facilitate entry and removal of the flat mirror within the receptacle. The mirror opening is capable of being opened and closed by releasable fastening means attached to the sidewalls of the receptacle in proximity to the opening.

The flat mirror and flat mirror compartment of the receptacle are substantially complementary configured to one another. Preferably, the receptacle member including the flat mirror compartment, and therefore, the mirror, are generally rectangularly shaped. A releasable fastening means may comprise a hook and pile fastening means which is attached to the sidewalls in confronting relationship to one another within the flat mirror compartment of the receptacle. The preferred receptacle material is a polymer, and more specifically a polyvinyl chloride material.

The key ring and the mirror pouch receptacle are pivotally and foldably connected to one another to position the key ring and receptacle in generally overlapped relationship for convenient carrying or storage thereof. The pivotal and foldable connection is accomplished through the use of a link which pivotally and foldably secures the key ring to the receptacle. The link is a U-shaped member having depending legs which straddle the receptacle, with the depending legs being secured at outer free ends thereof to each other through the sidewalls of the receptacle in order to secure the link to the receptacle, and with the key ring being pivotally and foldably received within the U-shaped link when secured to the receptacle. The link is preferably secured to a polygonal corner area of a polygonally configured receptacle forming the mirror pouch.

These and other objects of the present invention will become more apparent to those skilled in the art upon reviewing the description of the preferred embodiment in conjunction with the drawings.

DESCRIPTION OF THE PREFERRED EMBODIMENT

Figure 1:
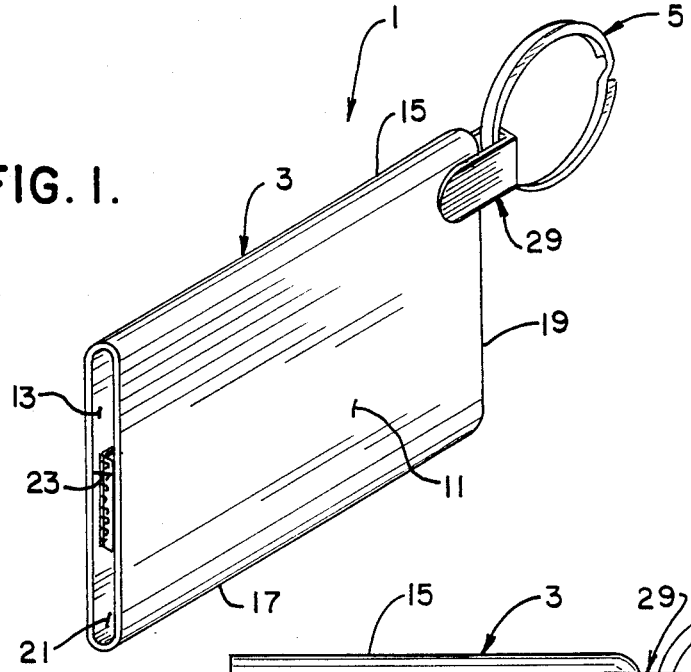
FIG. 1 is an isometric view of the mirror pouch with associated key ring constructed in accordance with the teachings of the present invention.
Figure 2:
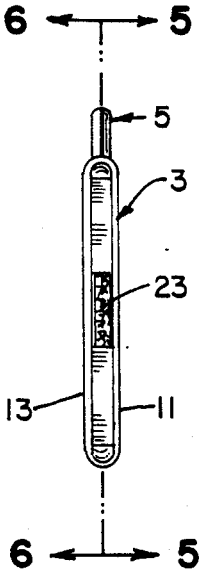
FIG. 2 is a front end elevational view thereof.
Figure 3:
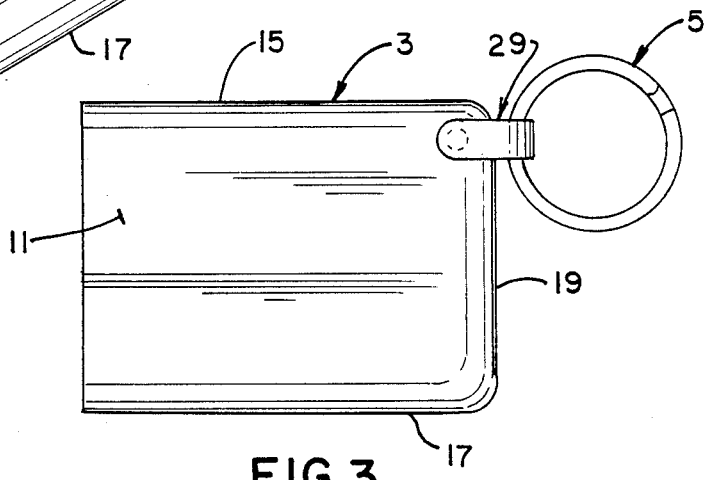
FIG. 3 is a top plan view thereof.
Figure 4:
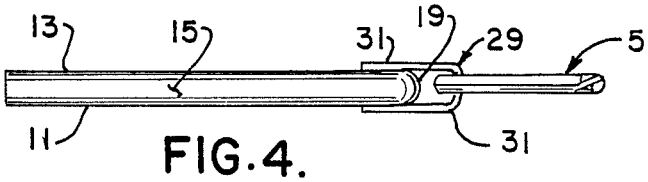
FIG. 4 is a side view thereof.

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

As shown in FIGS. 1–7 of the drawings, the mirror pouch 1 of the present invention includes a receptacle or enclosure member 3 and associated key ring 5 or other equivalent element such as a small key chain, if desired. The receptacle or enclosure member 3 is formed as an integral one-piece element which is constructed of a resilient and flexible material, such as a polymer elastomeric, preferably polyvinyl chloride, by well known custom polymer molding methods readily available in the art. In addition to being formed from a resilient and flexible material, the receptacle 3 includes a flat mirror compartment 7 (See FIGS. 5–6) for receiving a flat mirror 9 therein. As seen in the drawings, both the flat mirror 9 and the receptacle 3 are complementary configured relative to one another, preferably in the rectangular polygonal shape shown in the drawings.

The flattened enclosure or receptacle 3 includes a pair of opposing sidewalls 11, 13 which are integrally connected to one another at least around a substantial portion of the perimeter thereof through the opposed side edges 15, 17 which are integrally connected to the opposing sidewalls 11, 13 and to each other at one closed end edge 19. Opposite to the closed end edge 19 is an opening 21 which is of sufficient size to define an opening for entry and removal of the flat mirror 9 relative to the receptacle 3 and its flat mirror compartment 7.

The resilient and flexible material from which the receptacle 3 is constructed, together with the opposed generally flat sidewalls 11, 13, when integrally connected through the side edges 15, 17 and end edge 19, has a perimeter integral connection that allows the receptacle 3 to be temporarily deformed by force applied around the integrally connected periphery thereof, enabling the sidewalls 11, 13 to be separated from one another to facilitate entry and removal of the flat mirror 9 within the flat mirror compartment 7 of the receptacle 3.

The flexibility and resiliency inherent in the type of polymer chosen is important in order to enable the flat enclosure or flat receptacle 3 to function as described above. As disclosed in my aforementioned prior copending parent application entitled "COIN PURSE" bearing Ser. No. 07/307,920 filed Feb. 9, 1989, I have disclosed that a molded polymer having a Shore hardness of between about 70–75 has been quite desirable to achieve the purposes of the present invention, and the thickness of the polymer, when functioning in the preferred form of the invention, has been found to be quite effective in the vicinity of 1/16 of an inch more or less. Material formulations for the polymer that are used will determined those changes that may be essential for the final product with respect to its texture, hardness, color reception, material thickness, and in addition its endurance, after sustained usage. Not only does the vinyl material, preferably used for the flat enclosure or flat receptacle 3, allow for its construction as shown in the drawings, but the polyvinyl chloride material is also receptive to the imprinting or bonding of various advertising for company messages or indicia, as may be desired. Glossy ink applied to the polymer surfaces give the appearance of two part molding, while furnishing a rather lasting impression on the flat enclosure or receptacle 3. Such inks, when applied to this type of vinyl material, normally resist wear, fading, flexing, even when it comes into contact with other chemicals, so as to resist deterioration thereof.

Figure 5:
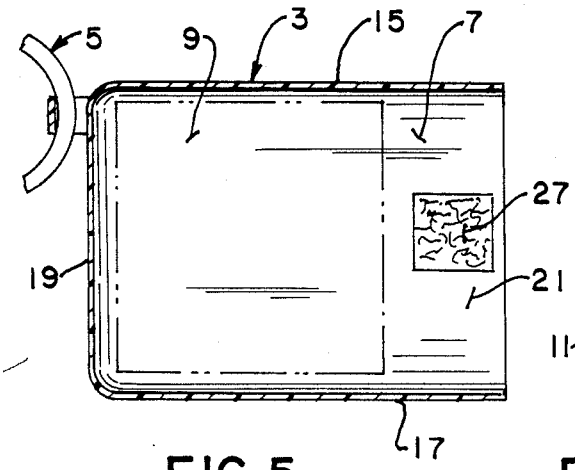
FIG. 5 is a transverse sectional view taken along line 5—5 of FIG. 2.
Figure 7:
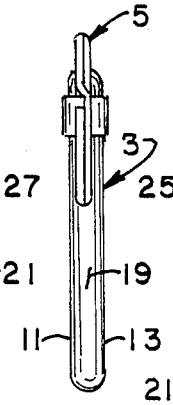
FIG. 7 is a back end elevational view thereof.
Figure 6:
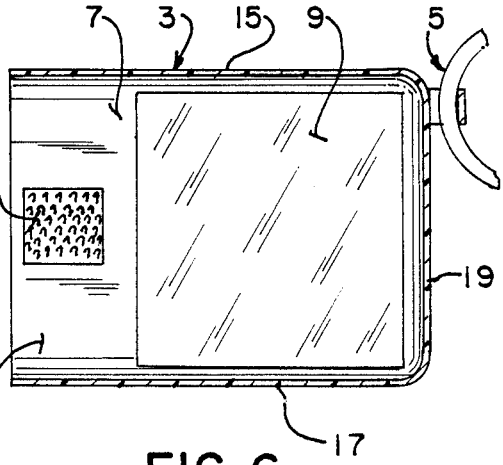
FIG. 6 is a transverse sectional view taken along line 6—6 of FIG. 2.

Proximate or adjacent the mirror opening 21, there is provided releasable fastening means 23 for maintaining the flat opposed side walls 11, 13 in proximity to one another, thereby maintaining the mirror 9 in captured or trapped position within the mirror compartment 7 of the flat receptacle 3. The fastening means 23 preferably comprises what is generally known as a "Velcro-Type releasable fastening device, including a hook 25 and pile 27 type of fastener, as shown in FIGS. 5–6. It will noted that the hook 25 and pile 27 fasteners are attached to the side walls 11, 13 in confronting relationship to one another within the flat mirror compartment 7, and also are centrally proximately located relative to the mirror compartment 7, so as to prevent inadvertent removal of the mirror 9. It will be understood that other types of releasable fastening devices such as a snap fastener or snap clasp fastening means may be employed in lieu of the hook and pile type of "Velcro" fastener, if desired.

The mirror pouch 1 of the present invention is associated preferably with a key ring 5 or equivalent device such as a small key chain, if desired. As shown in the drawings, the key ring 5 is pivotally and foldably connected to the flat receptacle 3 in order to position the key ring 5 and flat receptacle 3 in generally overlapped relationship to one another for convenient carrying or storage thereof. This is made possible through the use of the U-shaped link member 29 wherein the depending legs 31, 31 thereof straddle the flat receptacle (See FIG. 4), and with the free ends of the depending legs 31, 31 being secured at their outer free ends to each other through the side walls 11, 13 of the flat receptacle 3, in order to secure the link 29 to the receptacle 3. Thus, not only may the key ring 5 be rotatably or pivotally moved relative to the U-shaped link 29, there is sufficient space between the closed end edge 19 and the key ring 5 in order to allow the key ring 5 to be foldably positioned in overlapped relationship to the flat receptacle 3, thus allowing car and home rings carried by the key ring 5 to be positioned in close proximity to the flat receptacle 3, to facilitate carrying and storage thereof.

It will be further noted that the U-shaped link 29 is mounted in the rounded rectangular upper corner area of the flat receptacle 3, thereby enabling the U-shaped link 29 to be pivotally moved about the upper rectangular corner area to position the key ring 5 along the closed end edge 19 or along the upper side edge 15 of the flat receptacle 15.

When the flat mirror 9 is secured within the flat mirror compartment 7 of the flat receptacle 3, the upper and lower side edges 15, I7 and the closed end edge 19 of the flat receptacle provide a rigid construction although made from resilient and flexible material, thereby not only protecting the mirror 9 against breakage thereof, but also enabling the upper and lower side edges 15, 17 of the flat receptacle 3 to be gripped so as to open the mirror opening 21, once the releasable fastening means 23 is disengaged. This allows for the mirror 9 to be quickly inserted and withdrawn from the mirror compartment 7 of the flat receptacle 3, as may be desired.

Variations or modifications to the subject matter of this invention may occur to those skilled in the art upon reviewing the invention as described herein. Such variations or modifications if within the spirit of this invention, are intended to be encompassed within the scope of any claims to patent protection issuing upon this development. The description of the preferred embodiment set forth herein is done so for illustrative purposes only.

We claim:

1. A mirror pouch comprising an integral one-piece receptacle constructed of a resilient and flexible material, said receptacle defining a flat mirror compartment and including a pair of generally flat side walls integrally connected to one another at least around a substantial portion of the perimeter thereof and also being separated from one another along a predetermined area thereof which is sufficient to define an opening for entry and removal of the flat mirror within said receptacle, said receptacle being temporarily deformable by force applied around the integrally connected periphery thereof to separate the resilient side walls from one another so as to facilitate entry and removal of said flat mirror within said receptacle, said mirror opening being opened and closed by releasable fastening means attached to the side walls of said receptacle in proximity to said opening, said flat mirror and the flat mirror compartment of said receptacle being substantially complementary configured, said receptacle being generally rectangularly shaped, said releasable fastening means comprising a hook and pile fastening means, the side walls forming the complementary configured flat mirror compartment extending further forwardly towards its mirror opening and beyond the proximate edge of any mirror located therein, said hook and pile fastening means being attached to said side walls in confronting relationship within the flat mirror compartment applied to the interior of said side wall extensions beyond the proximate mirror edge to hold said side walls into engaged position, for retention of the flat mirror within said receptacle, said hook and pile fastening means capable of being separated upon the application of force to the receptacle perimeter at the edges of said receptacle opening to provide clearance for the insertion or removal of the flat mirror within said receptacle, and upon the release of said force the resilient side walls inherently collapsing into continguity to provide for the automatic re-engagement of the hook and pile fastening means for retaining the receptacle opening into closure and the retention of any flat mirror therein, and said receptacle being formed of a resilient polymer material.

2. The mirror pouch as defined in claim 1 wherein said polymer material being polyvinyl chloride.

3. The mirror pouch as defined in claim 2 and including a key ring or the like attached to said receptacle, said key ring and said receptacle being pivotally and foldably connected to one another to position said key ring and receptacle in generally overlapped relationship for convenient carrying or storage thereof.

4. The mirror pouch as defined in claim 3 and including a link pivotally and foldably securing said key ring to said receptacle.

5. The mirror pouch as defined in claim 4 wherein said link is a U-shaped member having depending legs which straddle the receptacle, said depending legs being secured at outer free ends thereof to each other through the side walls of said receptacle to secure the link to said receptacle, said key ring being pivotally and foldably received within the U-shaped link when secured to said receptacle.

6. The mirror pouch as defined in claim 5 wherein said receptacle member has a polygonal exterior configuration, and said link is secured to said receptacle in a polygonal corner area remote from said mirror opening.

7. A mirror pouch comprising an integral one-piece receptacle constructed of a resilient and flexible material, said receptacle defining a flat mirror compartment and including a pair of generally flat side walls integrally connected to one another at least around a substantial portion of the perimeter thereof and also being separated from one another along a predetermined area thereof which is sufficient to define an opening for entry and removal of the flat mirror within said receptacle, said receptacle being temporarily deformable by force applied around the integrally connected periphery thereof to separate the side walls from one another so as to facilitate entry and removal of said flat mirror within said receptacle, said mirror opening being opened and closed by releasable fastening means attached to the side walls of said receptacle in proximity to said opening, said flat mirror and the flat mirror compartment of said receptacle are substantially complementary configured, a key ring or the like attached to said receptacle, said key ring and said receptacle being pivotally and foldably connected to one another to position said key ring and receptacle in generally overlapped relationship for convenient carrying or storage thereof, a link pivotally and foldably securing said key ring to said receptacle, said link being a U-shaped member, having depending legs which straddle the receptacle, said depending legs being secured at outer free ends thereof to each other through the side walls of said receptacle to secure the link to said receptacle, said key ring being pivotally and foldably received within the U-shaped link when secured to said receptacle, said receptacle having a polygonal exterior configuration, and said link being secured to said receptacle in a polygonal corner area remote from said mirror opening, said receptacle being generally rectangularly shaped, said releasable fastening means comprising a hook and pile fastening means, said hook and pile fastening means being attached to said side walls in confronting relationship within the flat mirror compartment of said receptacle in proximity to said mirror opening, said receptacle being formed of a polymer material, and said polymer material being polyvinyl chloride.

* * * * *